US011317184B2

(12) United States Patent
Zhang

(10) Patent No.: US 11,317,184 B2
(45) Date of Patent: Apr. 26, 2022

(54) VIBRATION SENSOR AND AUDIO DEVICE

(71) Applicant: AAC ACOUSTIC TECHNOLOGIES (SHENZHEN) CO., LTD., Shenzhen (CN)

(72) Inventor: Jinyu Zhang, Shenzhen (CN)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 38 days.

(21) Appl. No.: 16/994,666

(22) Filed: Aug. 17, 2020

(65) Prior Publication Data

US 2020/0413177 A1 Dec. 31, 2020

Related U.S. Application Data

(63) Continuation of application No. PCT/CN2019/093333, filed on Jun. 27, 2019.

(51) Int. Cl.
*H04R 1/04* (2006.01)
*H04R 19/04* (2006.01)

(52) U.S. Cl.
CPC ..... *H04R 1/04* (2013.01); *H04R 19/04* (2013.01); *H04R 2201/003* (2013.01); *H04R 2400/11* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,166,910 | B2 * | 1/2007 | Minervini | B81B 7/0064 257/704 |
| 8,577,063 | B2 * | 11/2013 | Yang | H04R 19/04 381/175 |
| 9,078,063 | B2 * | 7/2015 | Loeppert | H04R 1/086 |
| 2007/0202627 | A1 * | 8/2007 | Minervini | H04R 23/00 438/51 |
| 2013/0129133 | A1 * | 5/2013 | Inoda | H04R 1/08 381/337 |

* cited by examiner

*Primary Examiner* — Angelica M McKinney
(74) *Attorney, Agent, or Firm* — W&G Law Group

(57) ABSTRACT

The present disclosure provides a vibration sensor and an audio device. The vibration sensor includes a housing having an inner wall and an inner chamber, an elastic sheet, a mass piece and a MEMS chip having a back cavity, the elastic sheet, the mass piece and the MEMS chip being arranged in the chamber. The elastic sheet is attached to the inner wall, the mass piece is mounted on one side of the elastic sheet away from the inner wall. The elastic sheet covers the concave cavity and defines a first through hole communicated with the concave cavity. The mass piece is provided with a second through hole communicated with the first through hole. And the first and the second through holes communicate with the back cavity and the concave cavity. The vibration sensor provided by the present disclosure has simple structure, small height and high sensitivity.

18 Claims, 5 Drawing Sheets

VIBRATION SENSOR AND AUDIO DEVICE

FIELD OF THE PRESENT DISCLOSURE

The present disclosure relates to a field of microphone, in particular to a vibration sensor and an audio device.

DESCRIPTION OF RELATED ART

In related arts, a vibration sensor generally includes a housing, a mounting plate received in the housing, an elastic film attached to an upper side of the mounting plate, and a MEMS chip mounted on a lower side of the mounting plate and cooperatively forming a front cavity with the mounting plate. The mounting plate is provided with a through hole communicating the front cavity and the elastic film. Mass block vibrates up and down when external vibration signals are transmitted to the vibration sensor through such structure, causing change of the volume of the front cavity, and the gas pressure in the front cavity changes accordingly. The signal of pressure changing is picked up by the MEMS chip and is converted into electrical signals. However, the vibration sensors in the related arts have the problems of complicated structure and low sensitivity.

Therefore, it is necessary to provide a vibration sensor having simple structure and high sensitivity.

SUMMARY OF THE PRESENT DISCLOSURE

The disclosure aims to provide a vibration sensor having simple structure and high sensitivity.

In one aspect of the present disclosure, a vibration sensor is provided, including a housing having an inner wall and an inner chamber surrounded by the inner wall, an elastic sheet, a mass piece, and a MEMS chip having a back cavity, the elastic sheet, the mass piece and the MEMS chip are received in the inner chamber; the elastic sheet is attached to the inner wall, the mass piece is mounted on one side of the elastic sheet away from the inner wall, and the MEMS chip is mounted on one side of the mass piece away from the elastic sheet; the inner wall includes an fitting surface which is fixedly connected with the elastic sheet and recesses in a direction away from the elastic sheet to form a concave cavity; the elastic sheet covers the concave cavity and defines a first through hole communicating with the concave cavity; the mass piece is provided with a second through hole communicating with the first through hole; and the first through hole and the second through hole both communicating the back cavity with the concave cavity.

Further, the elastic sheet includes a frame, a sheet body received in the frame, and a connecting piece connecting the frame and the sheet body, the sheet body is spaced apart from the frame to form a groove; the first through hole is defined in the sheet body, and the mass piece is mounted on the sheet body.

Further, the frame and the sheet body are rectangular, the quantity of the connecting piece is four, each of the four side edges of the frame and corresponding each of the four side edges of the sheet are arranged at intervals, and two ends of each connecting piece are respectively connected between the side edges of the frame and the side edges of the sheet body which are arranged facing to each other at intervals.

Further, the connecting piece includes a connecting strip disposed in the groove and in parallel with the side edges of the sheet body, a first bent part connecting one end of the connecting strip to the frame, and a second bent part connecting the other end of the connecting strip to the sheet body.

Further, the vibration sensor further includes a sealing part arranged around the mass piece for sealing the groove.

Further, the sealing part is sealant.

Further, the chamber includes a circuit board and an upper shell fixed on the circuit board, and the circuit board defines the inner wall.

Further, the cross-sectional area of the concave cavity is larger than the cross-sectional area of the back cavity in a vibration direction of the elastic sheet.

Further, the vibration sensor further includes an integrated circuit chip accommodated in the inner chamber, and the integrated circuit chip is electrically connected between the MEMS chip and the circuit board.

An audio device is also provided, which includes the vibration sensor as described above.

The disclosure has the advantages as follows. The MEMS chip and the mass piece are mounted on the side of the elastic sheet away from the concave cavity, and the MEMS chip and the mass piece vibrate up and down when the external vibration signal is transmitted to the vibration sensor through such structure, causing change of the volume of the concave cavity, and the gas pressure in the concave cavity changes accordingly. The signal of pressure changing is picked up by the MEMS chip and is converted into an electrical signal. The vibration sensor provided by the present disclosure has a simple structure, a small height, and a high sensitivity.

DETAILED DESCRIPTION OF THE EXEMPLARY EMBODIMENT

The present disclosure will be further described below with reference to the drawings and embodiments.

Figure 1:
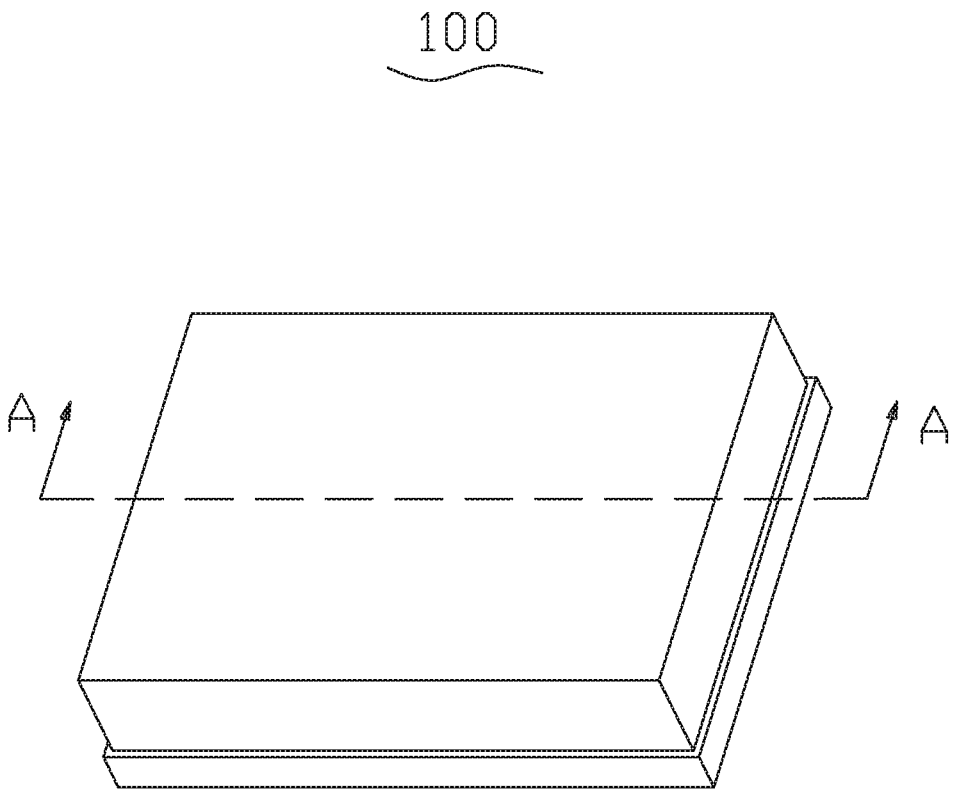
FIG. 1 is a schematic diagram of a vibration sensor according to the embodiments of the present disclosure.
Figure 2:
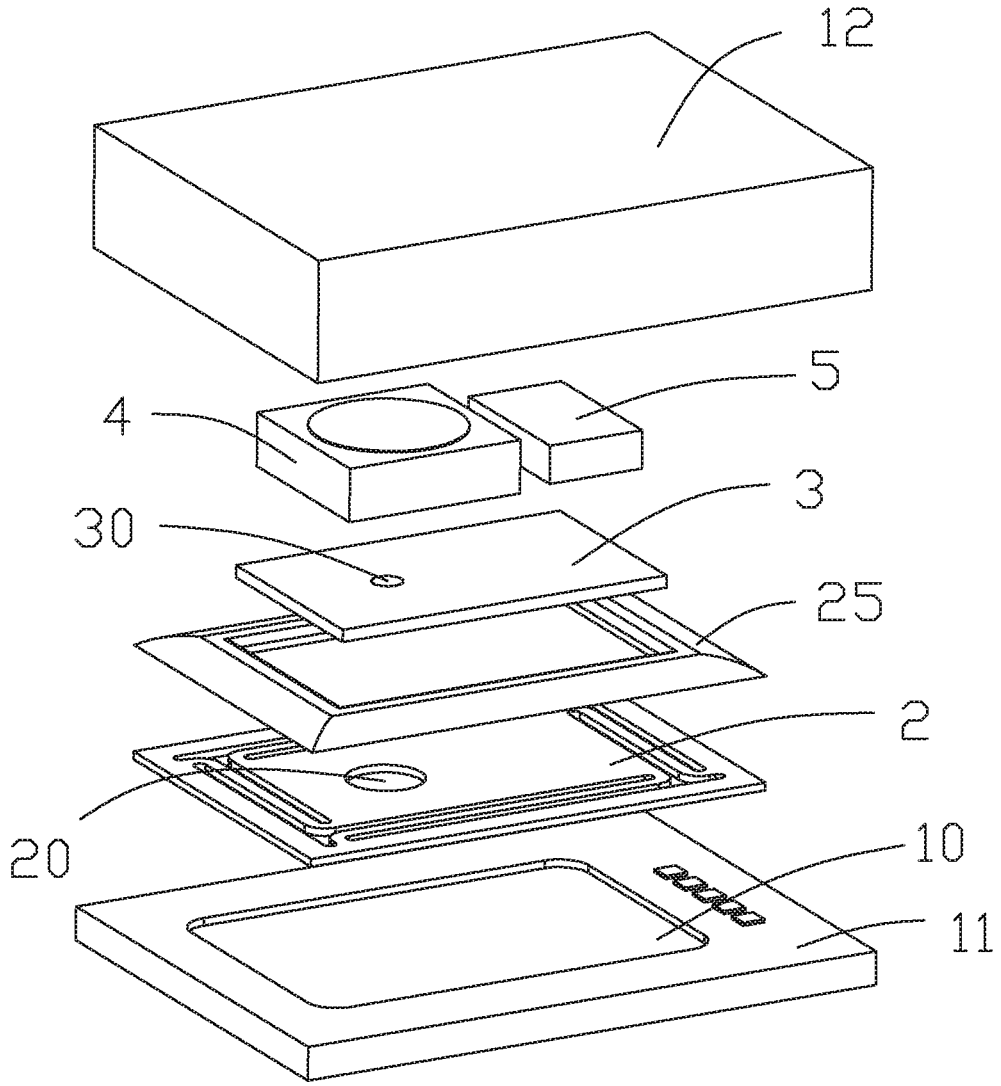
FIG. 2 is an exploded view of the vibration sensor in FIG. 1.
Figure 3:
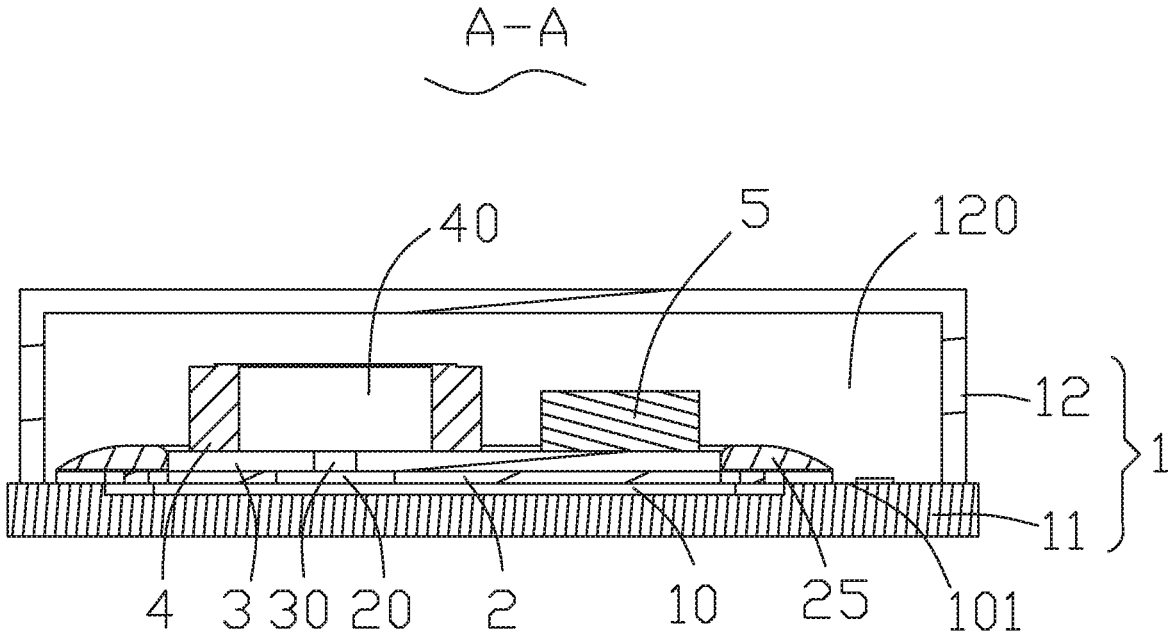
FIG. 3 is a sectional view taken along line A-A in FIG. 1.
Figure 4:
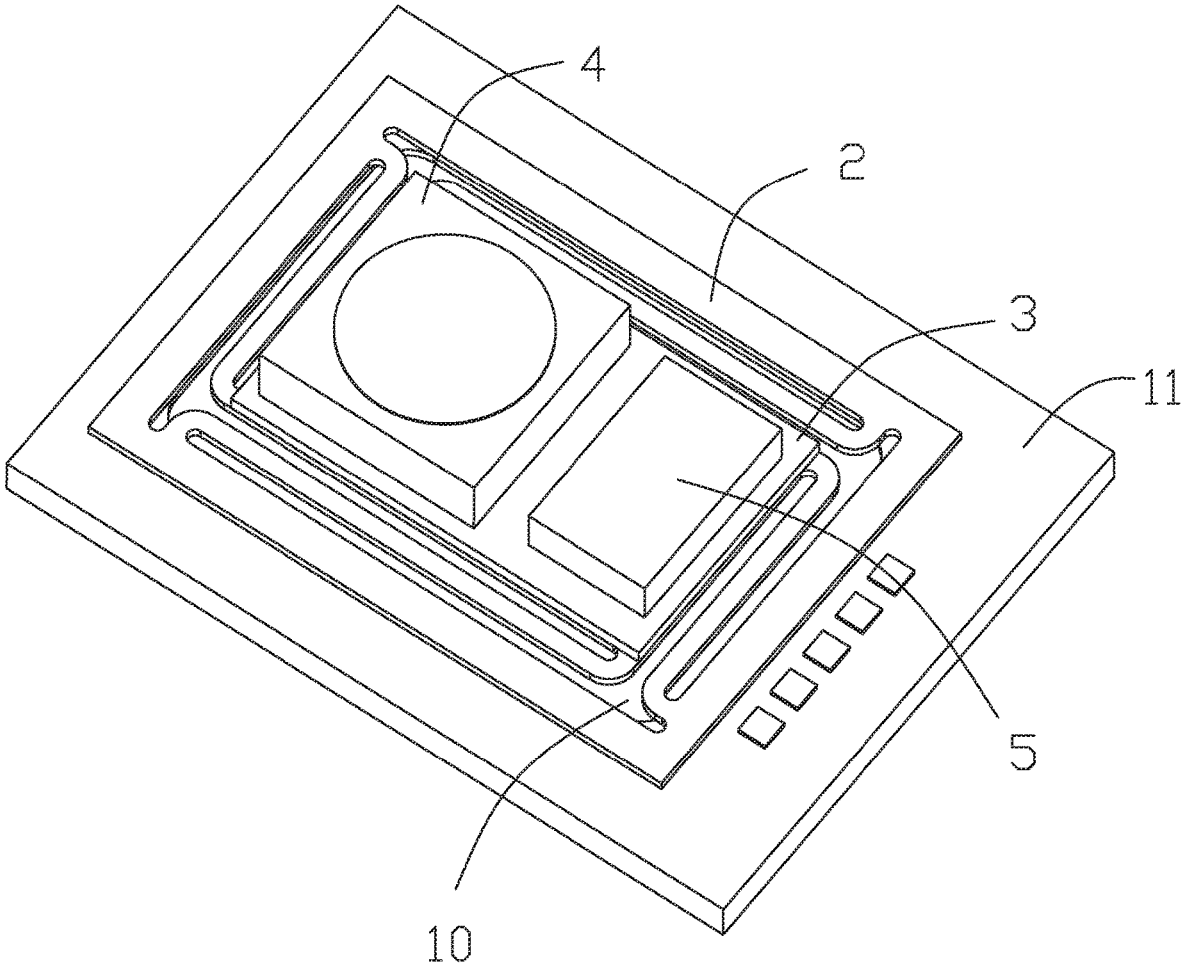
FIG. 4 is a schematic diagram of the vibration sensor with the housing and the sealing part removed according to the embodiments of the present disclosure.
Figure 5:
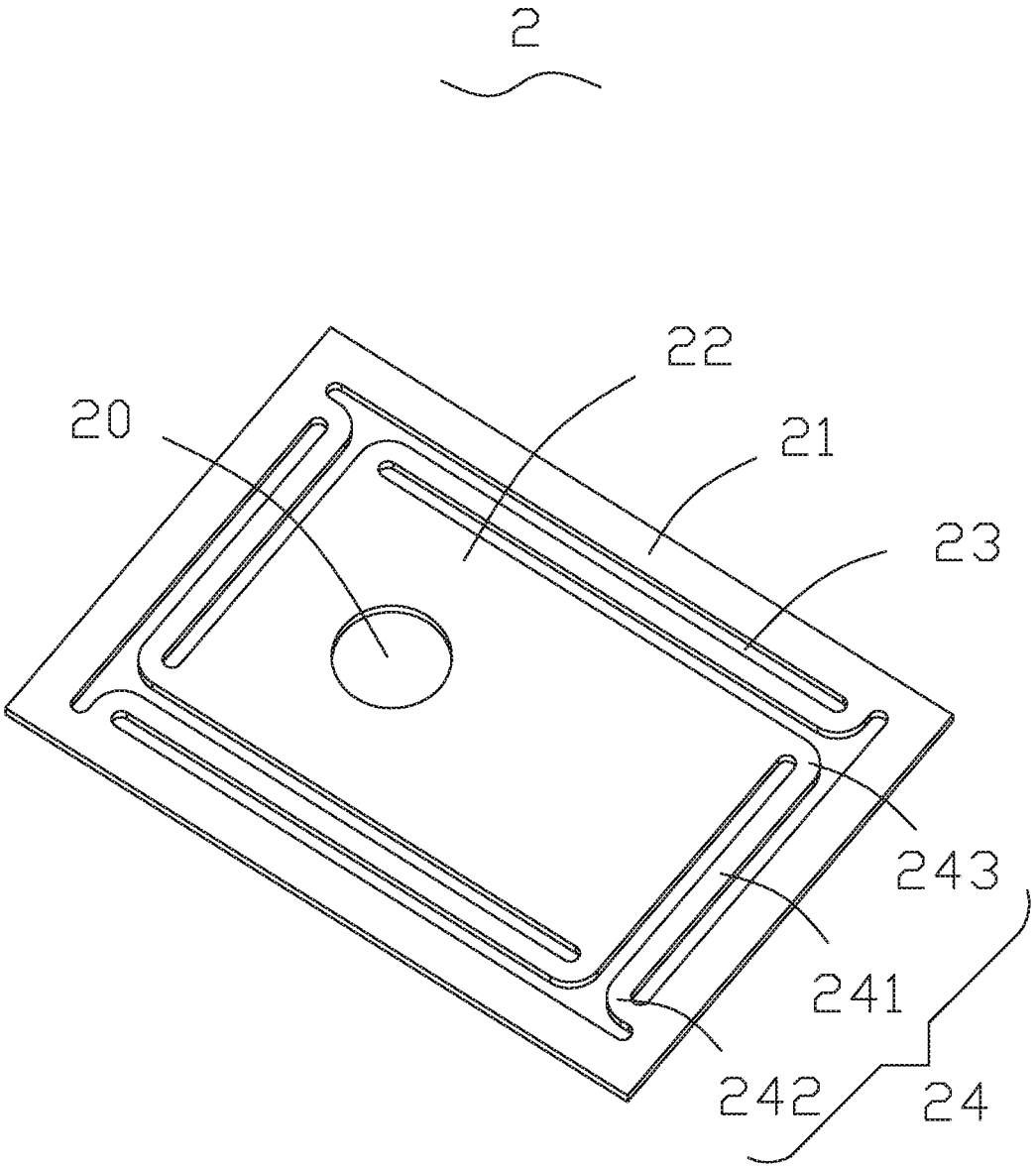
FIG. 5 is a schematic structural diagram of an elastic sheet in the vibration sensor according to the embodiments of the present disclosure.

A vibration sensor 100, referring to FIGS. 1 through 3, includes a housing 1 having an inner wall and an inner chamber 120 surrounded around by the inner wall, an elastic sheet 2, a mass piece 3, and a MEMS chip 4 having a back cavity 40; the elastic sheet 2, the mass piece 3, and the MEMS chip are all received in the inner chamber 120 of the housing 1. The elastic sheet 2 is attached to the inner wall, the mass piece 3 is mounted on one side of the elastic sheet 2 away from the inner wall, and the MEMS chip 4 is mounted on one side of the mass piece 3 away from the elastic sheet 2. The inner wall includes an fitting surface 101 which is fixedly connected with the elastic sheet 2 and recesses in a direction away from the elastic sheet 2 to form a concave cavity 10, the elastic sheet 2 covers the concave cavity 10, and the elastic sheet 2 is provided with a first through hole 20 communicating with the concave cavity 10. The mass piece 3 is provided with a second through hole 30 communicating with the first through hole 20, and the first through hole 20 and the second through hole 30 communicating the back cavity 40 with the concave cavity 10.

The MEMS chip 4 is mounted on the upper side of the elastic sheet 2. The MEMS chip 4 and the mass piece 3 vibrate up and down along with the elastic sheet 2 when external vibration signal is transmitted to the vibration sensor 100 through a structure, causing change of the volume of the concave cavity 10, and the gas pressure in the concave cavity 10 changes accordingly. The signal of pressure changing is picked up by the MEMS chip 4, the mass piece 3 improves the vibration effect, and the vibration sensor 100 becomes more sensitive. Besides, the height of the vibration sensor 100 is reduced as a result of replacement of the mass block with the MEMS chip 4 and the mass piece 3.

Optionally, the elastic sheet 2 includes a frame 21, a sheet body 22 arranged in the frame 21, and a connecting piece 24 connecting the frame 21 and the sheet body 22. The sheet body 22 is spaced apart from the frame 21 to form a groove 23. The first through hole 20 is defined in the sheet body 22, and the mass piece 3 is mounted on the sheet body 22.

Connecting the sheet body 22 with the frame 21 through the connecting piece 24 improves the elasticity of the sheet body 22 relative to the frame 21 and improves the effect of vibrating up and down of the sheet body 22. The frame 21 may be shaped as a circular, a rectangular, or any other shapes, and the sheet body 22 may be shaped as a circular, a rectangular or irregular shape. The frame 21 and the sheet body 22 are defined spaced apart from each other to form an annular groove 23.

Optionally, the frame 21 and the sheet body 22 are rectangular, and the quantity of the connecting piece 24 is four. Each of the four side edges of the frame 21 and corresponding each of the four side edges of the sheet body 22 are arranged at intervals, and the two ends of each connecting piece 24 are respectively connected with the side edges of the frame 21 and the side edges of the sheet body 22 which are arranged at intervals.

The concave cavity 10 is rectangular, and the frame 21 and the sheet body 22 are shaped to fit the shape of the concave cavity 10. The connecting piece 24 may be straight, and be perpendicular to the side edges of the sheet body 22 and to the inner side of the frame 21, or be inclined relative to the side edges of the sheet body 22 and the inner side of the frame 21, that is, each side edge which connects the sheet body 22 and the inner side of the frame 21 are spaced apart to form two diagonal corners of a rectangular groove.

Optionally, the connecting piece 24 includes a connecting strip 241 located in the groove 23 and being in parallel with the side edge of the sheet body 22, a first bent part 242 connecting one end of the connecting strip 241 to the frame 21, and a second bent part 243 connecting the other end of the connecting strip 241 to the sheet body 22.

The longer the connecting strip 241 is, the greater the elasticity is. The first bent part 242 and the second bent part 243 enhance the connection between the connecting strip 241 and the frame 21 and the connection between the connecting strip 241 and the sheet body 22, respectively.

Optionally, the vibration sensor 100 also includes a sealing part 25 arranged around the mass piece 3 for sealing the groove 23. The sealing part 25 is used to seal the groove 23 and thus to seal the concave cavity 10.

Optionally, the sealing part 25 is a sealant.

Optionally, the chamber 1 includes a circuit board 11 and an upper shell 12 fixed on the circuit board 11, and the circuit board 11 is used as the inner wall.

The upper shell 12 has an inner chamber 120 facing to the circuit board 11, the upper shell 12 covers the elastic sheet 2, the mass piece 3, and the MEMS chip 4, and the circuit board 11 used as the inner wall of the housing 1, which makes full use of the circuit board 11 and reduces the size of the vibration sensor 100.

Specifically, the inner chamber 120 of the upper shell 12 is formed as a rear cavity of the vibration sensor 100, and the concave cavity 10 and the elastic sheet 2 cooperatively form a front cavity of the vibration sensor 100.

Optionally, the MEMS chip 4 is a MEMS microphone chip or a MEMS pressure sensor chip.

Optionally, the cross-sectional area of the concave cavity 10 along the vibration direction of the elastic sheet 2 is larger than that of the back cavity 40 along the vibration direction of the elastic sheet 2.

Optionally, the vibration sensor 100 also includes an integrated circuit chip 5 accommodated in the inner chamber 120, and the integrated circuit chip 5 is electrically connected between the MEMS chip 4 and the circuit board 11.

The integrated circuit chip 5 is configured for processing the signal of pressure changing picked up by the MEMS chip 4.

The present disclosure also provides an audio device (not shown in the figures), which includes the vibration sensor 100 as described above.

The above is only an embodiment of the present disclosure, and it should be pointed out that for ordinary technicians in this field, improvements can be made without departing from the concept of this disclosure, but these all belong to the protection scope of the present disclosure.

What is claimed is:

1. A vibration sensor, comprising:

a housing having an inner wall and an inner chamber surrounded by the inner wall, an elastic sheet, a mass piece, and a microelectromechanical systems (MEMS) chip having a back cavity, wherein, the elastic sheet, the mass piece, and the MEMS chip is received in the inner chamber;

the elastic sheet is attached to the inner wall, the mass piece is mounted on one side of the elastic sheet away from the inner wall, and the MEMS chip is mounted on one side of the mass piece away from the elastic sheet;

the inner wall comprises a fitting surface fixedly connected with the elastic sheet and recesses in a direction away from the elastic sheet to form a concave cavity;

the elastic sheet covers on the concave cavity, and defining a first through hole communicated with the concave cavity;

the mass piece has a second through hole communicating with the first through hole; and the first through hole and the second through hole communicates the back cavity with the concave cavity.

2. The vibration sensor according to claim 1, wherein the elastic sheet comprises a frame, a sheet body received in the frame, and a connecting piece connecting the frame and the sheet body, the sheet body being spaced apart from the frame to form a groove; wherein the first through hole is defined in the sheet body, and the mass piece is mounted on the sheet body.

3. The vibration sensor according to claim 2, wherein the frame and the sheet body are rectangular, a quantity of the connecting piece is four, each of the four side edges of the frame and corresponding each of the four side edges of the sheet body are arranged at intervals, and two ends of each connecting piece are respectively connected between the side edges of the frame and the side edges of the sheet body which are arranged facing to each other at intervals.

4. The vibration sensor according to claim 3, wherein the connecting piece comprises a connecting strip arranged in the groove and in parallel with the side edges of the sheet body, a first bent part connecting one end of the connecting strip to the frame, and a second bent part connecting another end of the connecting strip to the sheet body.

5. The vibration sensor according to claim 2, further comprising a sealing part arranged around the mass piece for sealing the groove.

6. The vibration sensor according to claim 5, wherein the sealing part is sealant.

7. The vibration sensor according to claim 1, wherein the housing comprises a circuit board and an upper shell fixed on the circuit board, and the circuit board defines the inner wall.

8. The vibration sensor according to claim 7, further comprising an integrated circuit chip accommodated in the chamber, and the integrated circuit chip being electrically connected between the MEMS chip and the circuit board.

9. The vibration sensor according to claim 1, wherein a cross-sectional area of the concave cavity along a vibration direction of the elastic sheet is larger than a cross-sectional area of the back cavity along the vibration direction of the elastic sheet.

10. An audio device, comprising a vibration sensor, the vibration sensor comprising a housing having an inner wall and an inner chamber surrounded by the inner wall, an elastic sheet, a mass piece, and a MEMS chip having a back cavity, wherein, the elastic sheet, the mass piece, and the microelectro-mechanical systems (MEMS) chip being received in the inner chamber; the elastic sheet being is attached to the inner wall, the mass piece being is mounted on one side of the elastic sheet away from the inner wall, and the MEMS chip being is mounted on one side of the mass piece away from the elastic sheet; the inner wall comprising comprises a fitting surface which is fixedly connected with the elastic sheet and recesses in a direction away from the elastic sheet to form a concave cavity; the elastic sheet covering covers on the concave cavity, and defining a first through hole communicated with the concave cavity; the mass piece has a second through hole communicating with the first through hole; and the first through hole and the second through hole communicates the back cavity with the concave cavity.

11. The audio device according to claim 10, wherein the elastic sheet comprises a frame, a sheet body received in the frame, and a connecting piece connecting the frame and the sheet body, the sheet body being spaced apart from the frame to form an groove;

wherein the first through hole is defined in the sheet body, and the mass piece is mounted on the sheet body.

12. The audio device according to claim 11, wherein the frame and the sheet body are rectangular, a quantity of the connecting piece is four, each of the four side edges of the frame and corresponding each of the four side edges of the sheet body are arranged at intervals, and two ends of each connecting piece are respectively connected between the side edges of the frame and the side edges of the sheet body which are arranged facing to each other at intervals.

13. The audio device according to claim 12, wherein the connecting piece comprises a connecting strip arranged in the groove and in parallel with the side edges of the sheet body, a first bent part connecting one end of the connecting strip to the frame, and a second bent part connecting another end of the connecting strip to the sheet body.

14. The audio device according to claim 11, further comprising a sealing part arranged around the mass piece for sealing the groove.

15. The audio device according to claim 14, wherein the sealing part is sealant.

16. The audio device according to claim 10, wherein the housing comprises a circuit board and an upper shell fixed on the circuit board, the circuit board defines the inner wall.

17. The audio device according to claim 16, further comprising an integrated circuit chip accommodated in the inner chamber, the integrated circuit chip being electrically connected between the MEMS chip and the circuit board.

18. The audio device according to claim 10, wherein a cross-sectional area of the concave cavity along a vibration direction of the elastic sheet is larger than a cross-sectional area of the back cavity along the vibration direction of the elastic sheet.

* * * * *